US007753498B2

(12) United States Patent
Ito

(10) Patent No.: US 7,753,498 B2
(45) Date of Patent: Jul. 13, 2010

(54) IMAGE RECORDING APPARATUS

(75) Inventor: Atsushi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 244 days.

(21) Appl. No.: 11/275,578

(22) Filed: Jan. 17, 2006

(65) Prior Publication Data

US 2006/0158480 A1 Jul. 20, 2006

(30) Foreign Application Priority Data

Jan. 18, 2005 (JP) ..... 2005-010839

(51) Int. Cl.
*B41J 2/045* (2006.01)
*B41J 2/165* (2006.01)

(52) U.S. Cl. ..... 347/71; 347/29

(58) Field of Classification Search ..... 347/29, 347/32, 71, 31, 72
See application file for complete search history.

(56) References Cited

U.S. PATENT DOCUMENTS 5,402,159 A 3/1995 Takahashi et al.
6,663,218 B2 * 12/2003 Uchida ..... 347/29
6,672,704 B2 * 1/2004 Katakura et al. ..... 347/23
6,926,382 B2 8/2005 Ito et al.
2002/0130918 A1 * 9/2002 Hayakawa et al. ..... 347/29
2004/0001124 A1 * 1/2004 Ito ..... 347/71
2004/0252158 A1 * 12/2004 Shindo ..... 347/35
2005/0078146 A1 * 4/2005 Sakurai ..... 347/33

FOREIGN PATENT DOCUMENTS

JP 1992341853 A 11/1992
JP 2003326712 A 11/2003
JP 2004025636 A 1/2004

* cited by examiner

*Primary Examiner*—Matthew Luu
*Assistant Examiner*—Lisa M Solomon
(74) *Attorney, Agent, or Firm*—Baker Botts L.L.P.

(57) ABSTRACT

There is disclosed an image recording apparatus including an inkjet printhead and a cap. The inkjet printhead has a plurality of pressure chambers, a common ink chamber that is commonly connected to the pressure chambers to supply ink therefrom to the pressure chambers, and a nozzle surface including a nozzle area and an overlapping area. In the nozzle area, a row of nozzles respectively connected to the pressure chambers are open, and the ink supplied to the pressure chambers is then supplied to the corresponding nozzles to be ejected therefrom. The overlapping area overlaps with the common ink chamber as seen in a direction perpendicular to the nozzle surface. The cap has a close-contact portion, and is brought into contact with, and away from, the nozzle surface, and when in contact with the nozzle surface, the cap airtightly closes the nozzle surface with the close-contact portion encircling the nozzle area and not contacting the overlapping area.

10 Claims, 13 Drawing Sheets

IMAGE RECORDING APPARATUS

INCORPORATION BY REFERENCE

The present application is based on Japanese Patent Application No. 2005-010839, filed on Jan. 18, 2005, the content of which is incorporated herein by reference.

BACKGROUND OF THE INVENTION

1. Field of the Invention

The invention relates to an image recording apparatus in which an inkjet printhead having nozzles and performing recording on a recoding medium by ejecting ink droplets from the nozzles is mounted.

2. Description of Related Art

There is conventionally known an image recording apparatus of a type in which an inkjet printhead which performs recording on a recording medium by ejecting ink droplets from nozzles thereof is mounted. In the image recording apparatus of such a type, to maintain an ejection performance thereof at a proper level, a maintenance operation is implemented to remove bubbles accumulated in the inkjet printhead, ink dried and solidified, and others, by sucking these undesired substances from the side of the nozzles. Hence, the image recording apparatus of the type usually has a maintenance portion at a position outside a recording area, within which the inkjet printhead performs recording on a recording medium while reciprocating or moving relatively to the recording medium, and near an end of a range of the reciprocation of the inkjet printhead.

The maintenance portion includes a cap that is brought into contact with, and away from, a nozzle surface where the nozzles are open. When the inkjet printhead is moved outside the recording area to a position where the cap is disposed, the cap is moved to the nozzle surface to cover the nozzle surface, and maintenance operations such as sucking operation is performed with a pump device connected to the cap. The cap is typically formed of an elastic material and includes a protruding portion that protrudes toward the nozzle surface such that when the protruding portion is in contact with the nozzle surface, the protruding portion surrounds open ends of the nozzles.

As the inkjet printhead mounted in the image recording apparatus, there is employed an inkjet printhead as disclosed in JP-A-2004-25636 (see FIG. 4), for instance, where a piezoelectric actuator is fixed on a back surface of a cavity unit formed by laminating a plurality of plates and having ink passages therein, as shown in FIG. 11 of the publication. The plates forming the cavity unit are seven plates including a nozzle plate through which a plurality of nozzles are formed in rows, a cavity plate in which a plurality of pressure chambers in communication with the respective nozzles are formed, and two manifold plates in which a plurality of common ink chambers from which ink is distributed to the pressure chambers are formed. Formed of the laminate of such plates, the cavity unit has the nozzles on a front side thereof, the pressure chambers on a backside thereof, and the common ink chambers between the nozzles and the pressure chambers. In the inkjet printhead disclosed in the publication, damper chambers are formed in a damper plate constituting bottom surfaces of the common ink chambers at positions corresponding to the common ink chambers.

In the inkjet printhead including the thus constructed cavity unit, each common ink chamber opens with a large opening area at a position near the nozzle surface, thereby decreasing a rigidity of a bottom portion under each common ink chamber, i.e., a wall disposed between the bottom surface of the common ink chamber and the nozzle surface.

Hence, in the technique of the publication, the rigidity of the bottom portion of the common ink chamber is enhanced by disposing another plate as a reinforcing plate directly on a backside of the nozzle plate. According to this arrangement, even when a cap is frequently brought into pressing contact, with a large force, with the nozzle surface for the above-mentioned maintenance operations, a deformation of the bottom portion of the common ink chamber that causes a defective ejection of ink droplet or damage of the cavity unit does not occur.

JP-A-2003-326712 (see FIGS. 7 and 11), for instance, discloses to laminate a plurality of plates such that a width of a common ink chamber progressively decreases toward a bottom portion, in order to enhance a rigidity of the bottom portion of the common ink chamber. By this arrangement, a sufficient mechanical strength against a pressing force from a cap in a maintenance operation is provided.

Meanwhile, there is a demand for reducing the width and thickness of the cavity unit to meet the tendency of reduction in the size and weight of the inkjet printhead.

However, the above-described arrangements, namely, the arrangement where the reinforcing plate is disposed directly on the back side of the nozzle plate, and the arrangement where a plurality of plates are so assembled that the width of the common ink chamber progressively decreases, suffers from a limitation in reducing the thickness, or a dimension in a direction of stacking or lamination of the plates, of the cavity unit. Thus, an improvement has been requested to reduce the size of the cavity unit.

SUMMARY OF THE INVENTION

This invention has been developed in view of the above-described situations, and therefore it is an object of the invention to provide an image recording apparatus in which an inkjet printhead does not deform even when a nozzle surface is pressed by a cap in a maintenance operation, and also the inkjet printhead is reduced in size and weight.

To attain the above object, the invention provides an image recording apparatus including an inkjet printhead and a cap. The inkjet printhead has a plurality of pressure chambers, a common ink chamber that is commonly connected to the pressure chambers to supply ink therefrom to the pressure chambers, and a nozzle surface including a nozzle area and an overlapping area. In the nozzle area, a row of nozzles respectively connected to the pressure chambers are open, and the ink supplied to the pressure chambers is then supplied to the corresponding nozzles to be ejected therefrom. The overlapping area overlaps with the common ink chamber as seen in a direction perpendicular to the nozzle surface. The cap has a close-contact portion, and is brought into contact with, and away from, the nozzle surface, and when in contact with the nozzle surface, the cap air-tightly closes the nozzle surface with the close-contact portion encircling the nozzle area and not contacting the overlapping area.

According to this arrangement, the protruding portion of the cap is configured to be disposed at a position not to intersect an area across which the common ink chamber extends in plan view. Thus, when the protruding portion is brought into close contact with the nozzle surface for a maintenance operation or in other situations, the place in the nozzle surface the protruding portion contacts differs from an area corresponding to the common ink chamber. Hence, even where the nozzle surface and the common ink chamber are close to each other and thus the wall between the nozzle surface and the common ink chamber is thin, this thin wall is not pressed by the protruding portion of the cap, and a deformation and damage of the cavity unit does not occur.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to the accompanying drawings.

By referring to FIGS. 1 to 7, there will be described an image recording apparatus according to a first embodiment of the invention.

Figure 1:
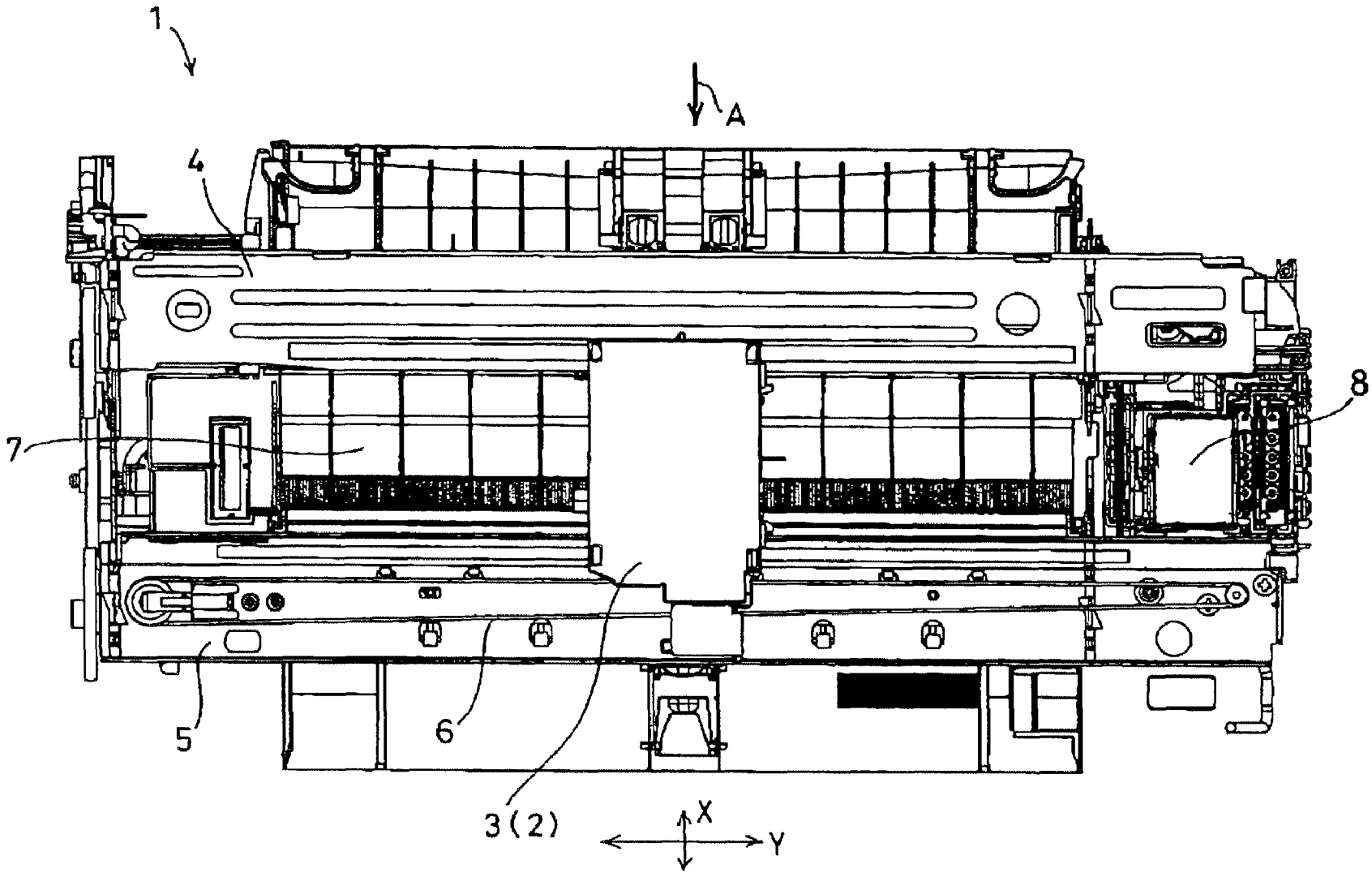
FIG. 1 is a perspective view of an image recording apparatus according to a first embodiment of the invention.

In FIG. 1, reference numeral 1 generally denotes an image recording apparatus of inkjet type according to the first embodiment. As shown in FIG. 1, the image recording apparatus 1 includes an inkjet printhead 2 mounted on a carriage 3. While reciprocated in a Y-axis direction, i.e., a main scanning direction perpendicular to an auxiliary scanning direction and an X-axis direction, over a recording medium as fed in a direction indicated by arrow A or the auxiliary scanning or X-axis direction, the inkjet printhead 2 ejects ink droplets onto the recording medium to record information or others on the recording medium. The image recording apparatus can constitute a printer apparatus by self, but may by incorporated as a printer function in a MFD (multi function device) having a copy function, a scanner function, a facsimile function, and/or others.

Figure 2:
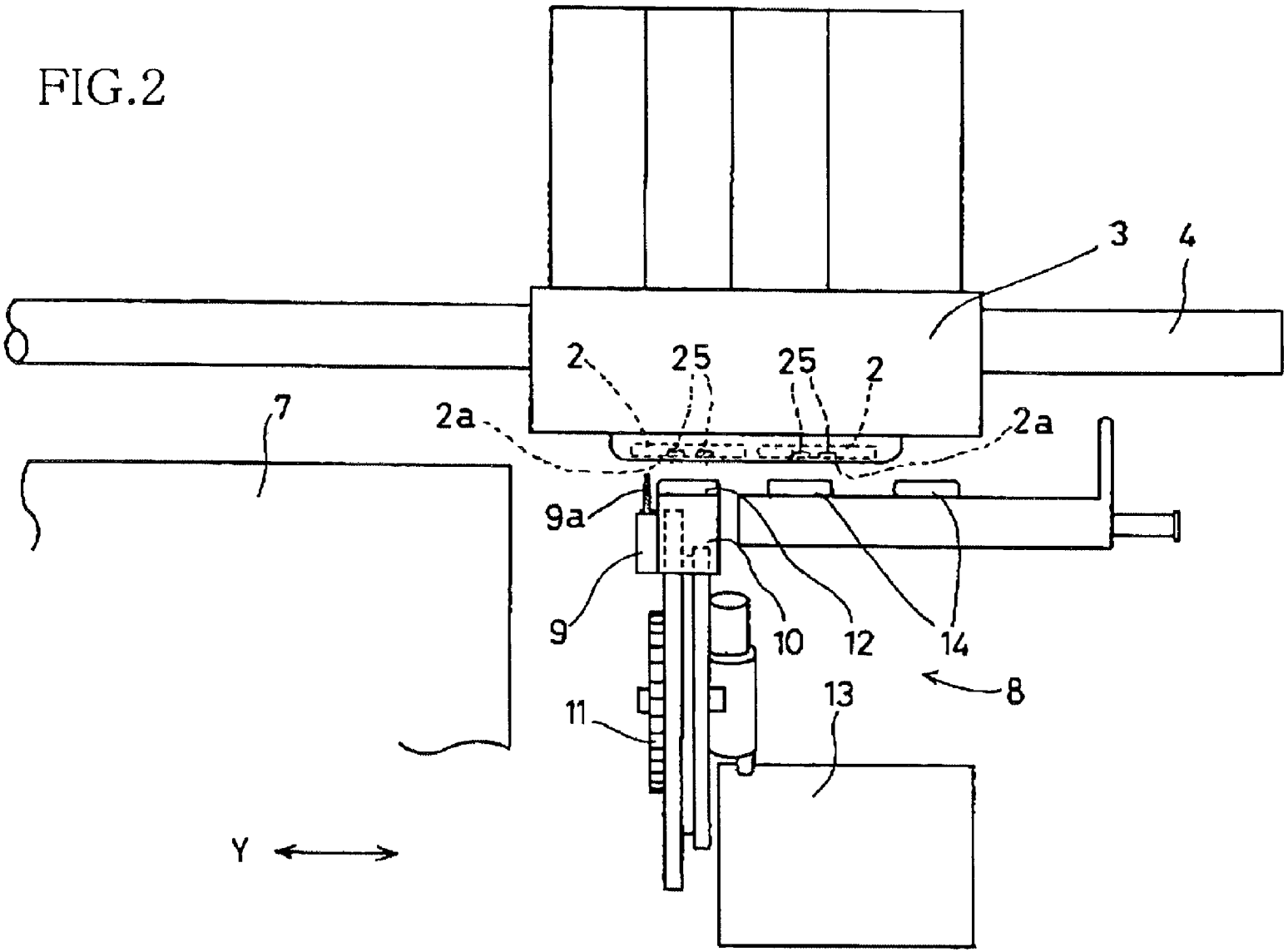
FIG. 2 is a schematic side view of a maintenance portion of the image recording apparatus and its vicinity.

In addition to the carriage 3 having the inkjet printhead 2 on its under side, the image recording apparatus 1 includes plate-like guide members 4, 5, a timing belt 6, a carriage motor (not shown), and a platen 7. The guide members 4, 5 extend parallel to each other in a transverse direction or along the Y-axis direction, and support the carriage 3 such that the carriage 3 can slide on the guide members 4, 5. The timing belt 6 coupled with the carriage 3 to reciprocate the carriage 3 along the guide members 4, 5. The carriage motor drives the timing belt 6. The platen 7 is a plate-like member disposed to support the recording medium as being fed from the under side. As shown in FIG. 2, in this embodiment two inkjet printheads 2 are arranged in the Y-axis direction on the carriage 3.

In the vicinity of an end (i.e., a rightmost position as seen in FIG. 1) of a reciprocation range of the carriage 3, which range is outside a recording area within which recording on the recording medium is performed, a maintenance portion 8 is disposed below the carriage 3 to be opposed to a nozzle surface 2*a* of each inkjet printhead 2 in which a plurality of nozzles 23 are formed, as shown in FIG. 2. At a maintenance position in the maintenance portion 8, a wiping device 9, a purging device 10, and a cam mechanism 11 for moving each of the wiping device 9 and the purging device 10 toward and away from the nozzle surface 2*a*.

The wiping device 9 includes a wiper member 9*a* like a pallet that is raised to contact the nozzle surface 2*a* by the cam mechanism 11 when the inkjet printhead 2 is located at the maintenance position. From this state, the carriage 3 is displaced so that the wiper member 9*a* slides on the nozzle surface 2*a* in order to wipe off ink droplets adhering to the nozzle surface 2*a* and others.

The purging device 10 includes a first cap 12 formed of an elastic member, and a pump device 13 connected to the first cap 12. The nozzle surface 2*a* is covered by the first cap 12, and ink, bubbles, and others inside the inkjet printhead 2 are sucked and removed by the pump device 13 from the side of the nozzles. In this way, defective ejection of ink droplets from the inkjet printhead 2 is prevented, and air bleeding upon initially introducing ink into the printhead 2 is performed. The purging device 10 has a single first cap 12, and the two inkjet printheads 2 are sequentially placed at a position corresponding to the first cap 12 by movement of the carriage 3 so as to perform the above-mentioned sucking operation individually for the printheads 2.

The maintenance portion 8 further includes two second caps 14 formed of elastic material and a cam mechanism (not shown), that are located at a reset position (or home position) more closer to the end (i.e., to the right of the purging device 10 as seen in FIGS. 1 and 2) of the reciprocation range of the carriage 3 than the maintenance position. The cam mechanism moves the second caps 14 toward and away from the nozzle surface 2*a*. The two second caps 14 cover the two inkjet printhead 2 at once when a recording operation is terminated and the carriage 3 is returned to the reset position, so as to prevent drying of the ink. The first cap 12 and the second caps 14 will be fully described later.

Figure 3:
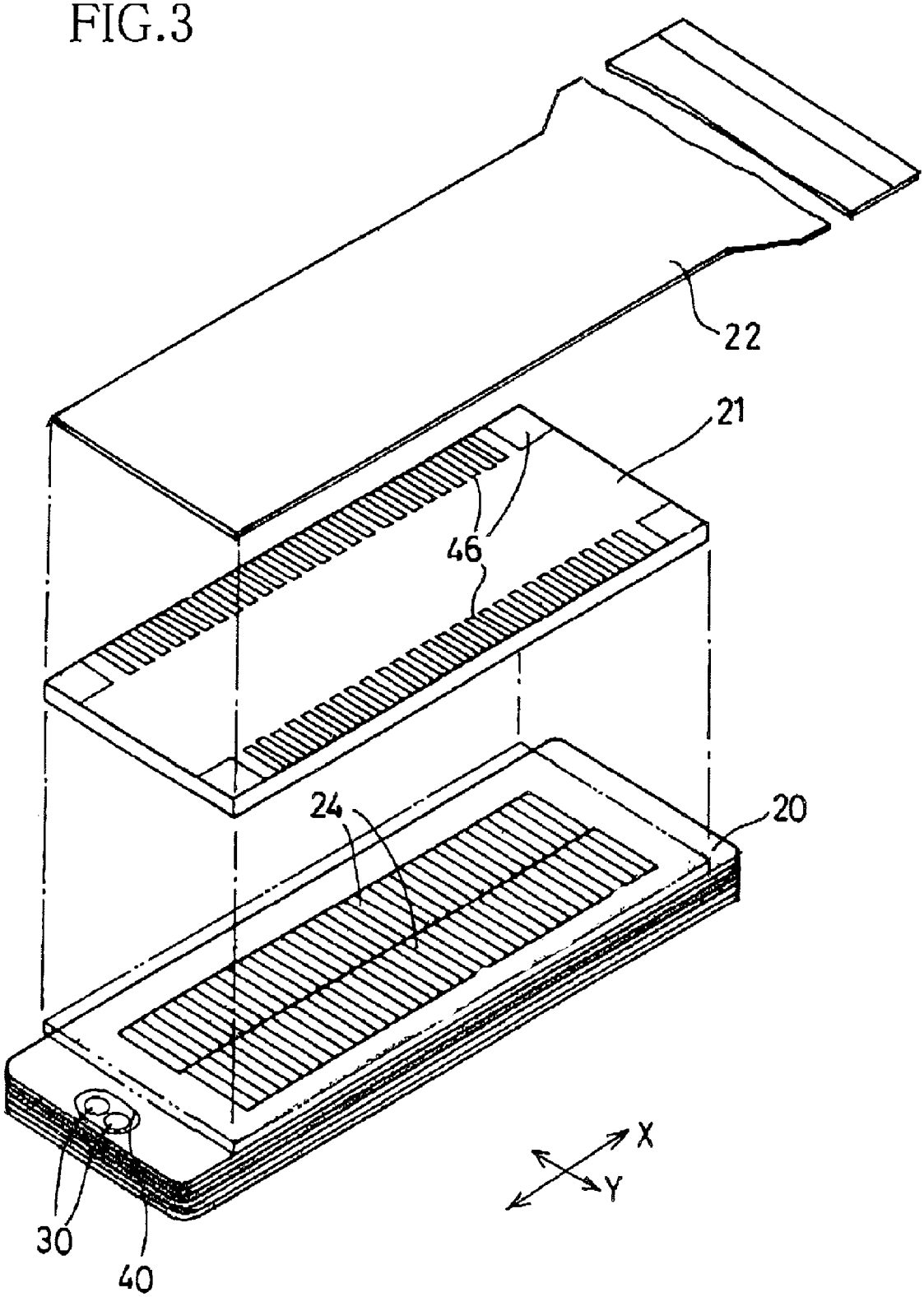
FIG. 3 is a perspective view of an inkjet printhead mounted in the image recording apparatus.

There will be described in detail a structure of the inkjet printhead 2. As shown in FIG. 3, the inkjet printhead 2 includes a cavity unit 20 formed of a plurality of plates, a planar piezoelectric actuator 21 fixed on the cavity unit, and a flexible flat cable 22 (shown in FIG. 6) superposed on and bonded to an upper surface of the piezoelectric actuator 21 for connection with an external device. From the nozzles 23 open in the nozzle surface 2*a* as a lower surface of the cavity unit 1, ink droplets are ejected downward.

Figure 4:
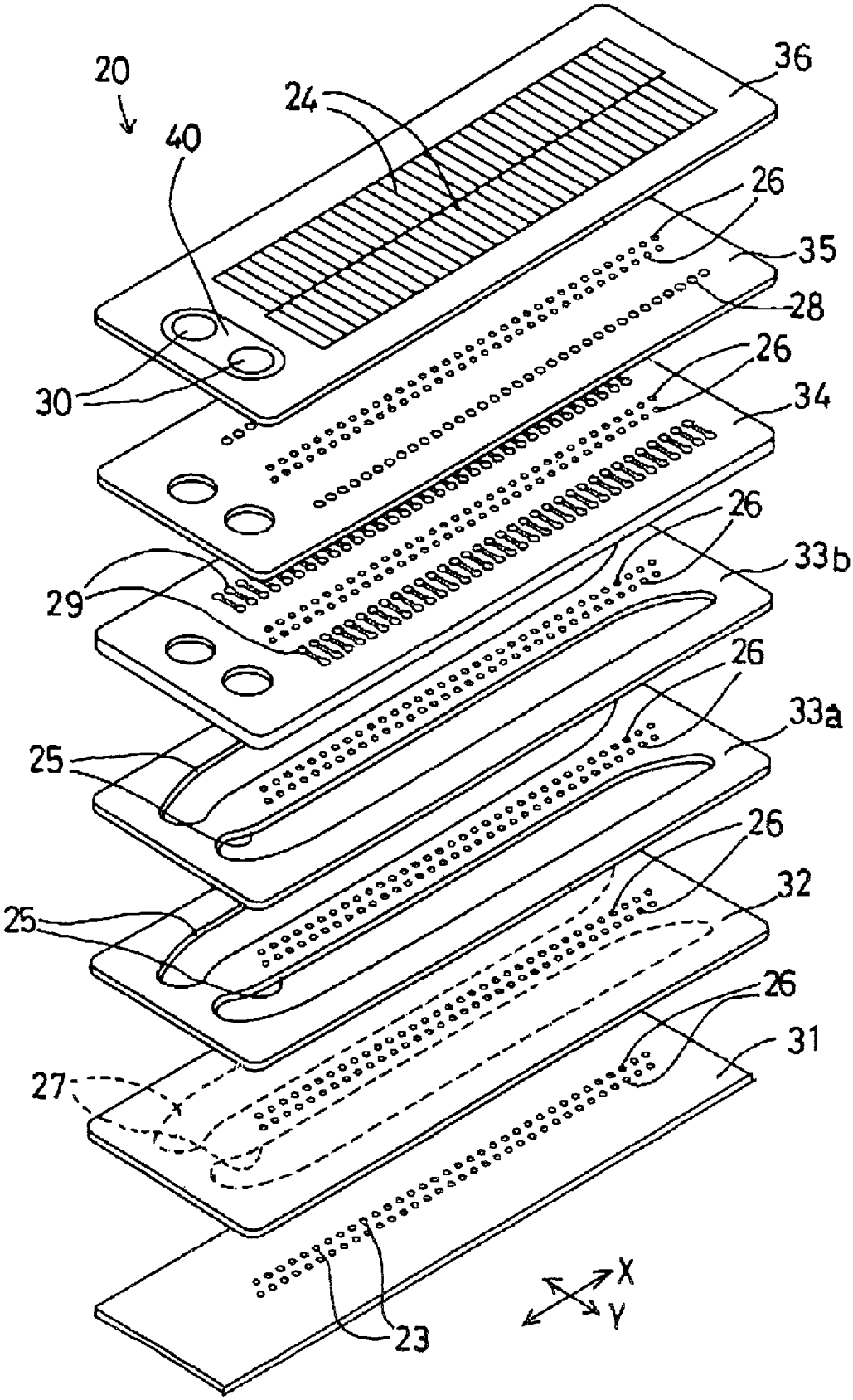
FIG. 4 is an exploded perspective view of the inkjet printhead.

As shown in FIG. 4, the cavity unit 20 is formed by stacking and bonding with an adhesive seven thin plates, namely, a nozzle plate 31, a damper plate 32, two manifold plates 33*a*, 33*b*, a supply plate 34, a base plate 35, and a cavity plate 36.

In the present embodiment, each of the plates 31-36 has a thickness of about 50-150 μm. The nozzle plate 31 is formed of synthetic resin such as polyimide, while the other plates 32-36 are formed of a nickel alloy steel sheet containing 42% of nickel. Through the nozzle plate 31, a large number of nozzles 23 having a small diameter of about 25 μm are formed for ejecting ink droplets therethrough. The nozzles 23 are arranged at small intervals, in two rows each extending along a first or longitudinal direction of the nozzle plate 31 (i.e., the X-axis direction), in a staggered fashion. A width of the nozzle plate 31 in the Y-axis direction is narrower than that of the other plates 32-36.

Figure 5:
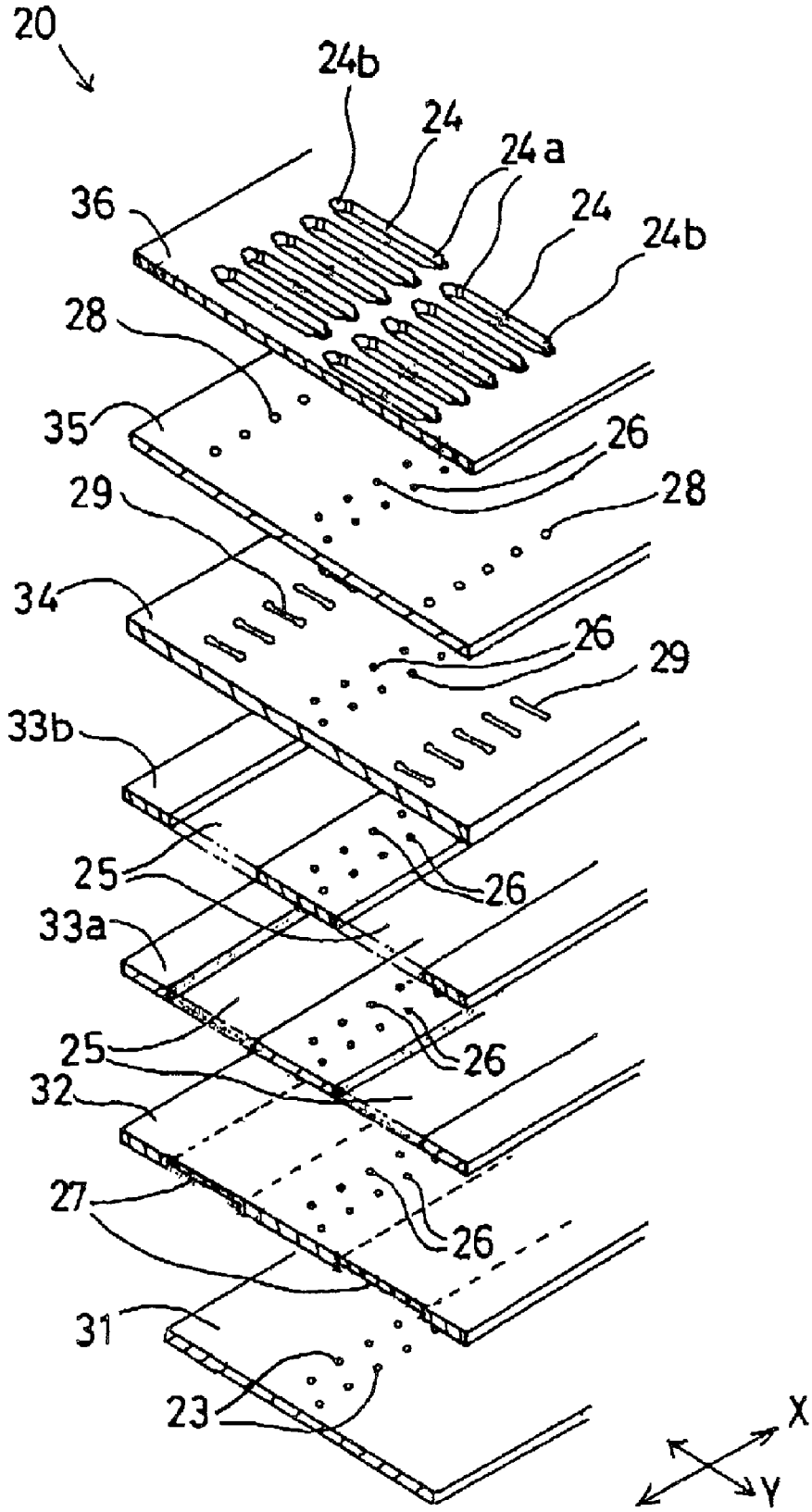
FIG. 5 is an exploded perspective view showing in enlargement a cavity unit of the inkjet printhead.

In the cavity plate 36, a plurality of pressure chambers 24 are arranged in two rows each extending along a longitudinal direction of the cavity plate 36, i.e., the X-axis direction, in a staggered fashion, as shown in FIGS. 4 and 5. The pressure chambers 24 are elongate in plan view, and the longitudinal direction of the pressure chambers is parallel to a direction of shorter sides of the cavity plate 36 or the Y-axis direction. A first end portion 24*a* of each elongate pressure chamber 24 is communicated with a corresponding one of the nozzles 23, and the other end portion or a second end portion 24*b* of the elongate pressure chamber 24 is communicated with a common ink chamber 25 described later.

The first end portions 24*a* of the pressure chambers 24 are communicated with the nozzles 23 formed in a staggered arrangement through the nozzle plate 31, via communication holes 26 formed through the base plate 35, the supply plate 34, the two manifold plates 33*b*, 33*a*, and the damper plate 32.

Figure 6:
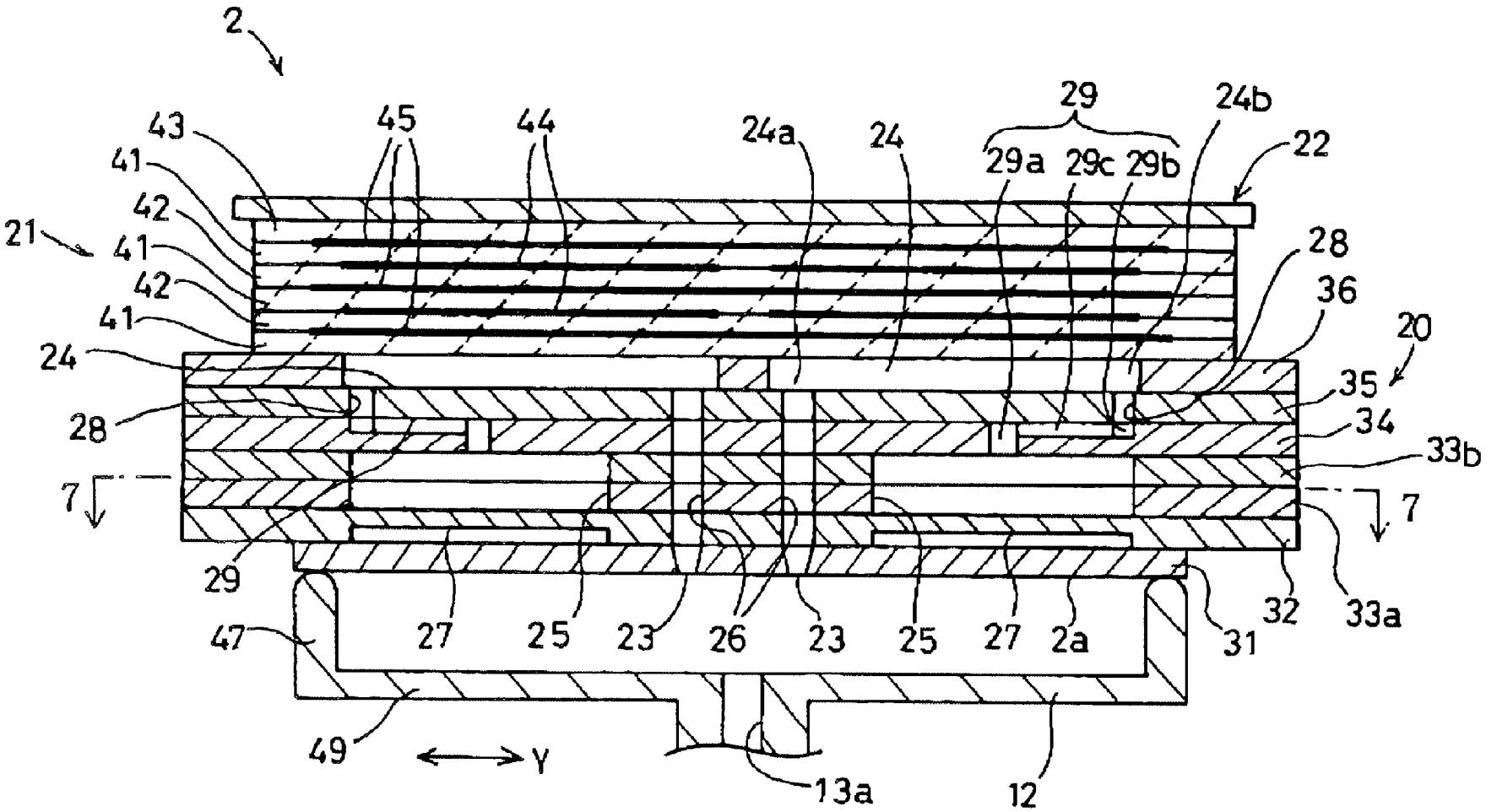
FIG. 6 is a cross-sectional view of the inkjet printhead as covered by a cap.

Through the two manifold plates 33*a*, 33*b*, two common ink chambers 25 each elongate in a longitudinal direction of the two manifold plates 33*a*, 33*b* (i.e., the X-axis direction) are formed. That is, the common ink chambers 25 extend along the respective rows of the nozzles 23. More specifically, as shown in FIG. 6, two manifold plates 33*a*, 33*b* are stacked and an upper surface of the stack is covered with the supply plate 34 while a lower surface of the stack is covered with the damper plate 32, thereby forming two closed common ink chambers or manifold chambers 25. Each common ink chamber 25 extends along a direction of each row of the pressure chambers 24 or the nozzles 23, and overlaps a part of each of the pressure chambers 24 of a corresponding row when seen in a direction of the stacking of the plates. When seen in a direction perpendicular to the nozzle surface 2*a*, each common ink chamber 25 is located between the pressure chambers 24 and the nozzle surface 2*a*.

As shown in FIGS. 5 and 6, on an under side of the damper plate 32 disposed immediately under the manifold plate 33*a*, there are formed two recesses as damper chambers 27 that are not in communication with the common ink chambers 25. The number, location, and shape of the damper chambers 27 are made coincident with those of the common ink chambers 25, as shown in FIG. 4. Since the damper plate 32 is a metallic material suitably deformable, each of thin ceiling portions over the respective damper chambers 27 can freely vibrate on both of the opposite sides, namely, toward the common ink chamber 25 and toward the damper chamber 27. When a pressure change occurs at a pressure chamber 24 upon ejection of a droplet of the ink, the pressure change may be propagated to the corresponding common ink chamber 25. However, even where the propagation of the pressure change occurs, the ceiling portion elastically deforms and vibrates to absorb and damp the pressure change. That is, the ceiling portion serves as a damper. Thus, a crosstalk, which is a propagation of a pressure change occurring at a pressure chamber 24 to another pressure chamber 24, is prevented.

Through the base plate 35 immediately under the cavity plate 36 are formed a plurality of through-holes 28 respectively connected to the second end portions 24*b* of the pressure chambers 24.

Through the supply plate 34 immediately under the base plate 35 are formed a plurality of connecting passages 29 for allowing ink communication between the common ink chambers 25 to the pressure chambers. Each of the connecting passages 29 has an inlet 29*a* for introducing the ink from the connected common ink chamber 25 into the connected pressure chamber 24, an outlet 29*b* open into the through-hole 28 on the side of the pressure chamber 24, and an orifice portion 29*c* between the inlet 29*a* and the outlet 29*b*. At the orifice portion 29*c*, a cross-sectional area of the connecting passage 29 is reduced in order to give the highest resistance to ink flow in the connecting passage 29.

As shown in FIG. 4, through the cavity plate 36 are formed two ink supply ports 30 as inlets through which the ink is introduced into the cavity unit 20. The two ink supply ports 30 are connected to longitudinal ends of the common ink chambers 25 through openings formed through the base plate 35 and the supply plate 34 at respective positions corresponding to the ink supply ports 30. To the ink supply ports 30, a filter member 40 is attached with an adhesive or others, such that filtering portions of the filter member 40 respectively cover open ends of the ink supply ports 30.

The piezoelectric actuator 21 is constructed as disclosed in JP-A-4-341853, for instance. That is, as shown in FIG. 6, a plurality of piezoelectric sheets 41-43 each having a thickness of about 30 μm are laminated, and narrow individual electrodes are formed in rows each extending in the longitudinal direction of the cavity unit 20 (i.e., the X-axis direction) on an upper major surface of each of the even-numbered piezoelectric sheets 42 as counted from the bottom, and at positions corresponding to the pressure chambers 24 in the cavity unit 20. On an upper major surface of each of odd-numbered piezoelectric sheets 41 as counted from the bottom, common electrodes 45 each common to a plurality of the pressure chambers 24 are formed. On an upper surface of a topmost sheet are formed surface electrodes 46 (shown in FIG. 3) electrically connected to the individual electrodes positionally corresponding in a direction of stacking of the sheets, and surface electrodes 46 electrically connected to the common electrodes. As well known in the art, upon application of a high voltage between the individual and common electrodes 44, 45, a portion of the piezoelectric sheets disposed between the individual and common electrodes 44, 45 is polarized and functions as an active portion.

An adhesive sheet (not shown) as an adhesive and formed of an ink impervious synthetic resin is attached on an entire lower surface (i.e., a major surface to be opposed to the pressure chambers 24) of the thus constructed planar piezoelectric actuator 2, and then the piezoelectric actuator 21 is bonded or fixed to the cavity unit 20 with the individual electrodes 44 of the actuator 21 opposed to the pressure chambers 24 of the cavity unit 20. The flexible flat cable 22 is superposed on and pressed against the upper surface of the piezoelectric actuator 21 to electrically connect various kinds of wiring patterns (not shown) in the flexible flat cable 22 to the surface electrodes 46.

The ink passages extend from the ink supply ports 30 of the cavity unit 20 to the respective nozzles 23. The ink is introduced from an ink supply source into each common ink chamber 25 through the ink supply port 30, and then distributed to the pressure chambers 24 via the connecting passages 29 formed in the supply plate 34 and the through-holes 28 formed in the base plate 35. In order to eject an ink droplet, a pressure is applied to a pressure chamber 24 by driving of the piezoelectric actuator 21 so as to produce a pressure wave at that pressure chamber 24, which is transmitted to the corresponding nozzle 23 through the communication hole 26, thereby ejecting an ink droplet.

In this embodiment, two inkjet printhead 2 each constructed as described above are disposed on the carriage 3 with their longer sides adjacent to each other, so that four color inks of respective colors are supplied to the respective ink supply ports 30 four in total Each of the first cap 12 and the second caps 14 has a bottom wall portion 49 (shown in FIG. 6) and a protruding portion 47 protruding from the bottom wall portion 49 toward the nozzle surface 2*a* so as to surround open ends of all the nozzles 23. Thus, the first cap 12 and the second caps 14 are configured to be open on their upper side. The first and second caps 12, 14 are formed of elastic material so that an upper end of the protruding portion 47 closely contacts the nozzle surface 2*a* when each of the first and second caps 12, 14 covers the nozzle surface 2*a*. The protruding portion 47 is disposed so as not to intersect an area across which the common ink chambers 25 extend in plan view.

Figure 7:
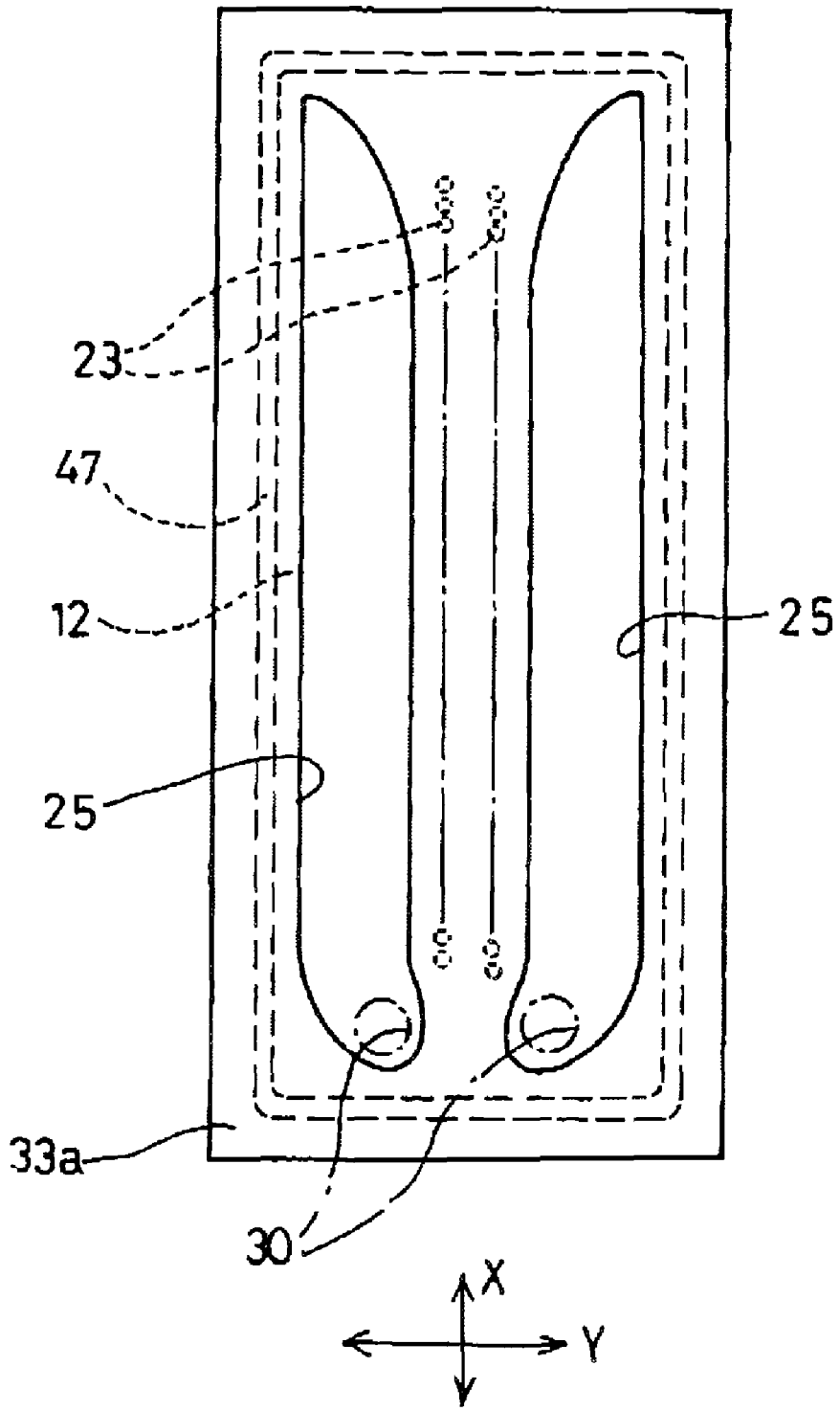
FIG. 7 is a view taken along line 7-7 in FIG. 6.

In this embodiment, the protruding portion 47 is formed in a frame-like shape to stand integrally from four edges of the first cap 12 that is substantially rectangular in plan view, as shown in FIGS. 6 and 7. In the plan view, the frame-like shape of the protruding portion 47 is located outside, or surrounds, an area including the two nozzle rows as well as the two elongate common ink chambers 25 disposed on the opposite sides of the nozzle rows. The bottom wall portion 49 of the first cap 12 has a connecting hole 13*a* for connection with the pump device 13. Each of the second caps 14 is identical in shape with the first cap 12 except that the second cap 14 does not have a connecting hole 13*a* since the second caps 14 are for tightly closing the nozzle surface 2*a*. FIGS. 6 and 7 show a state where the first cap 12 is in contact with the cavity unit 20, and each of the second caps 14 is also brought into contact with the cavity unit 20 in the same way, although not shown.

As described above, in the cavity unit 20 according to the first embodiment, the damper plate 32 is disposed directly on the back side of the nozzle plate 31. Thus, a rigidity of the nozzle plate 31 at a portion corresponding to the damper chambers 27 and common ink chambers 25 is lower than at the other portions. Even where the nozzle plate 31 is formed of metal, a sufficient rigidity can not be obtained. However, according to the embodiment where the protruding portion 47 of the first and second caps 12, 14 is disposed at a position not to intersect the common ink chambers 25 in plan view, as shown in FIGS. 6 and 7, the portion in the cavity unit 20 where the rigidity is relatively low is not pressed by the protruding portion 47, That is, at the portion of the cavity unit 20 which the protruding portion 47 contacts, a relatively large number of plates are laminated and thus the rigidity is relatively high. Hence, upon covering of the nozzle surface 2*a* of the cavity unit 20 by the cap 12, 14, pressing of the nozzle surface 2*a* by the protruding portion 47 of the cap 12, 14 does not cause any troubles such as deformation and damage of the cavity unit 20.

According to the first embodiment, the thickness (or the dimension in the direction of stacking of the plates) of the cavity unit and accordingly that of the inkjet printhead is reduced as well as the cost is reduced by the decrease in the number of the components, as compared to a conventional arrangement where a reinforcing plate of a sufficient thickness is interposed between the nozzle plate 31 and the damper plate 32 in order to reinforce a portion where the rigidity is low.

In this way, according to the first embodiment, even without a reinforcing member, such as a reinforcing plate, for increasing the rigidity at a damper portion of the cavity unit corresponding to an overlapping area, or the damper chambers 27 and the common ink chambers 24, the conventionally seen deformation of the cavity unit upon pressing by the cap is reliably prevented In other words, the thickness of the inkjet printhead is reduced, and a sufficient durability of the inkjet printhead against a pressing contact of the cap is obtained at the same time.

Figure 8:
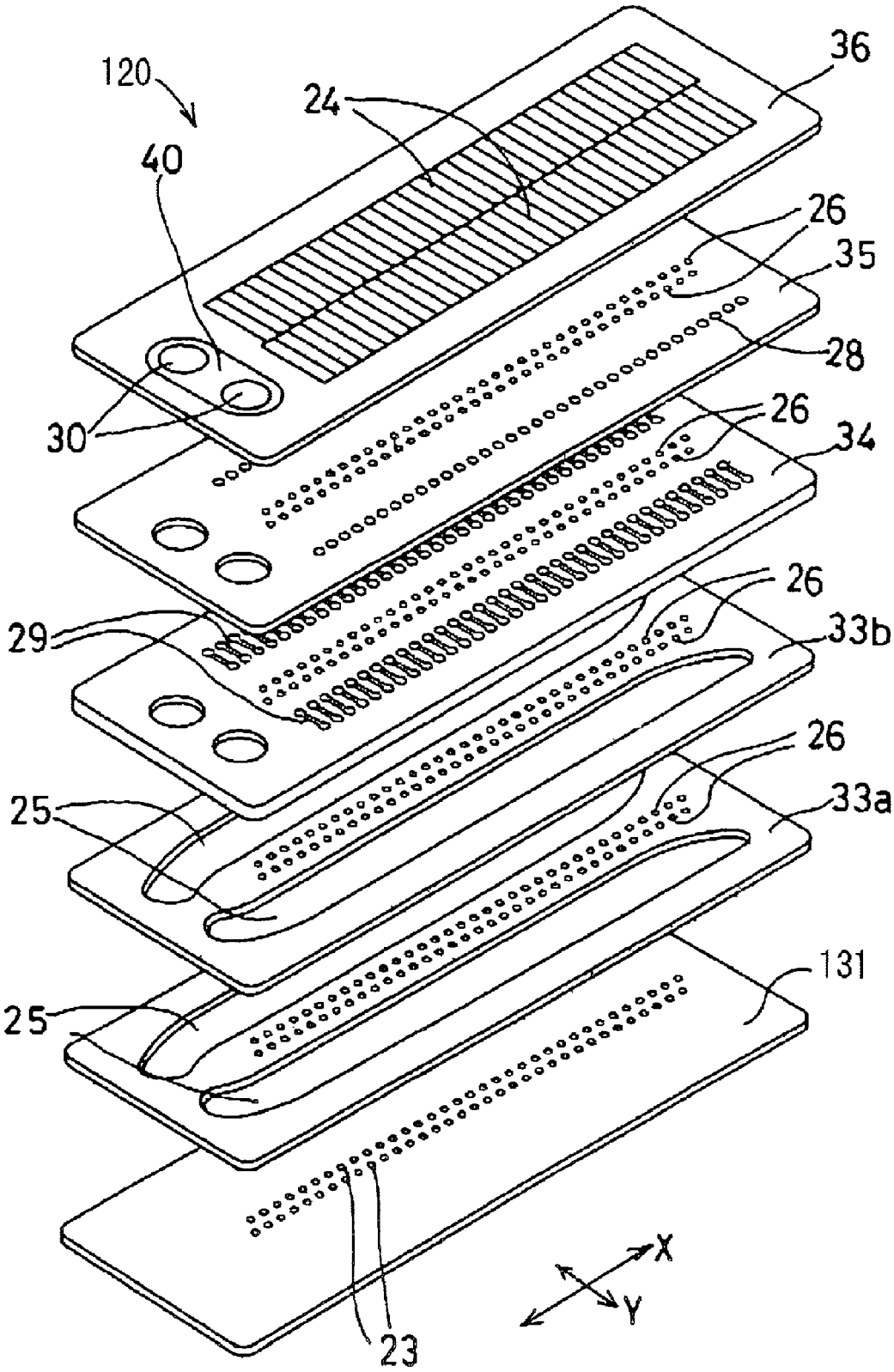
FIG. 8 is an exploded perspective view of an inkjet printhead mounted in an image recording apparatus according to a second embodiment of the invention.
Figure 9:
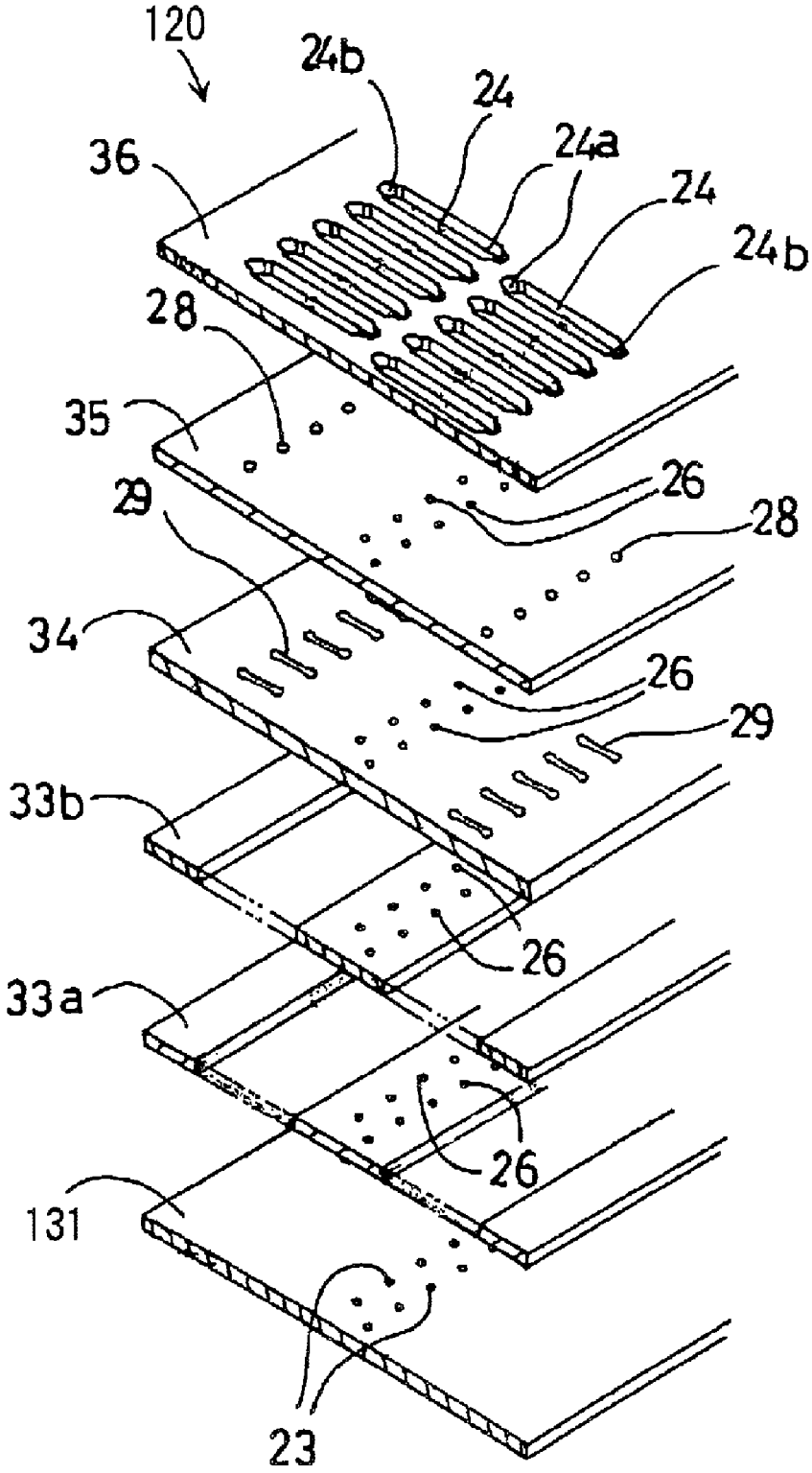
FIG. 9 is an exploded perspective view showing in enlargement a cavity unit of the inkjet printhead.
Figure 10:
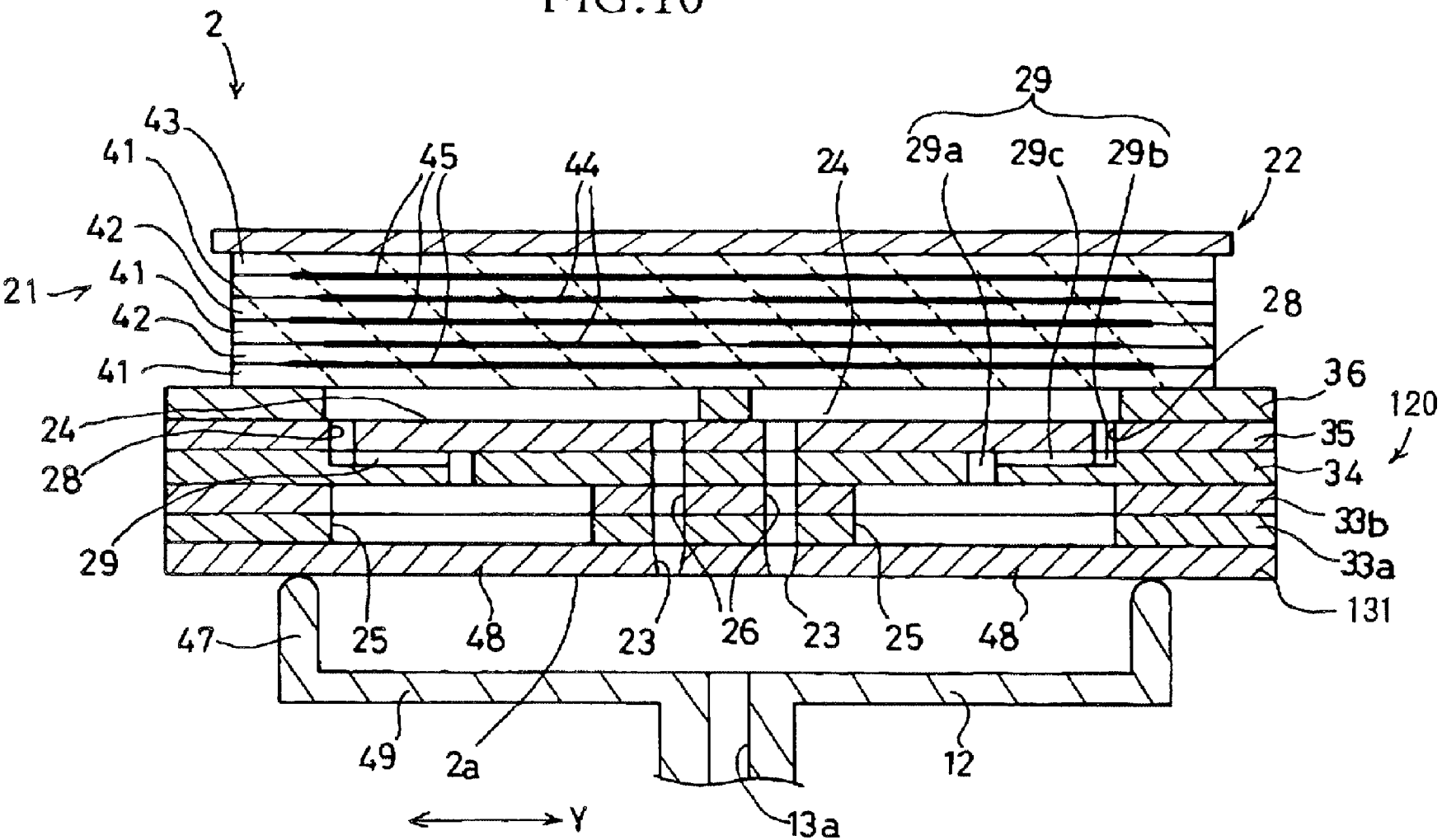
FIG. 10 is a cross-sectional view of the inkjet printhead as covered by a cap.

Referring to FIGS. 8-10, there will be described an image recording apparatus according to a second embodiment. FIG. 8 is an exploded perspective view of an inkjet printhead according to the second embodiment, FIG. 9 is an enlarged exploded perspective view of a cavity unit of the inkjet printhead, and FIG. 10 is a cross-sectional view of the inkjet printhead as covered with a cap. The second embodiment is different from the first embodiment in the structure of the cavity unit. Thus, the same parts or elements will be denoted by the same reference numerals and description thereof is dispensed with.

A nozzle plate 131 of a cavity unit 120 of the second embodiment is formed of synthetic resin and serves as a damper plate. Thus, unlike the first embodiment, a damper plate 32 is not included in the cavity unit 120 of the second embodiment. That is, in the second embodiment, a lower surface of a manifold plate 33*a* where common ink chambers are open are directly covered by the nozzle plate 131 of resin, so that a portion of the nozzle plate 131 which constitutes a bottom portion of each of the common ink chambers is utilized as a damper portion 48 (shown in FIG. 10).

In the second embodiment, the manifold plate 33*a* is disposed directly on the nozzle plate 131, thereby further reducing the thickness (or the dimension in the direction of stacking of the plates) of the cavity unit 120, as well as the cost by the decrease in the number of the components, as compared to the first embodiment including the damper plate 32. In this arrangement where the elastic nozzle plate 131 of resin constitutes the bottom portion of the common ink chamber 25 that serves as a damper portion 48, the rigidity of the bottom portion of the common ink chamber 25 is extremely low. However, in the second embodiment, too, the protruding portion 47 of each of the first and second caps 12, 14 is disposed not to intersect the common ink chambers 25 in plan view, and thus the portion having low rigidity in the cavity unit 120 is not pressed by the protruding portion 47. That is, at the portion in the cavity unit 120 that the protruding portion 47 contacts, the number of the plates stacked are relatively large and thus the rigidity is relatively high. Hence, pressing of the cavity unit 120 by the protruding portion 47 upon covering of the nozzle surface 2*a* with the cap 12 does not cause any problems such as deformation and damage of the cavity unit 120.

The nozzle plate 131 is typically formed of polyimide resin since the nozzles are easily formable with this material. Resin has lower rigidity than metal, and thus even where an area of the damper portion 48 is small, the damper portion 48 formed of resin vibrates more easily than a damper portion of metal and can give a sufficient damping effect. Hence, the second embodiment can reduce the number of the plates of the cavity unit 120, as well as an opening area of the common ink chamber 25, thereby enabling to reducing the width of the plates.

According to the second embodiment, too, even without a reinforcing member, such as a reinforcing plate, for increasing the rigidity at the damper portion of the cavity unit corresponding to an overlapping area, the conventionally seen deformation of the cavity unit upon pressing by the cap is reliably prevented.

In each of the above-described first and second embodiments, the protruding portion 47 is disposed outside, and to surround, the area including the nozzle rows and the common ink chambers 25 arranged correspondingly to the nozzle rows, at a position not to intersect the common ink chambers 25 in plan view. According to this structure, even where each inkjet printhead is reduced in size to decrease the above-mentioned area including the nozzle rows and the common ink chambers 25, an arrangement to surround this area with the protruding portion of the cap is easily realized, thereby enabling to reliably cover the open ends of the nozzles.

However, the invention is not limited to such a construction according to the above-described embodiments. That is, depending on the arrangement of elements such as the common ink chambers and nozzle rows, the protruding portion may be modified in configuration and/or disposition as long as the protruding portion does not intersect the common ink chambers in plan view.

For instance, although in each of the above-described embodiments, the nozzles are arranged in two rows in each inkjet printhead, an inkjet printhead having only one nozzle row, or three or more nozzle rows as in the following third fourth embodiments, may be employed. Where the nozzles are arranged in a large number of rows, the protruding portion may include a sectioning portion and a circumferential portion, as described in detail later with respect to a third embodiment of the invention, as long as the protruding portion does not intersect the common ink chambers in plan view.

Further, although in each of the above-described embodiments two inkjet printheads are mounted in the carriage, a single inkjet printhead, or three or more inkjet printheads, may be mounted in a single carriage.

Further, a single cap may cover a plurality of inkjet printheads at once.

A third and a fourth embodiment of the invention described below are other examples where the configuration and/or disposition of the protruding portion is modified.

Figure 11:
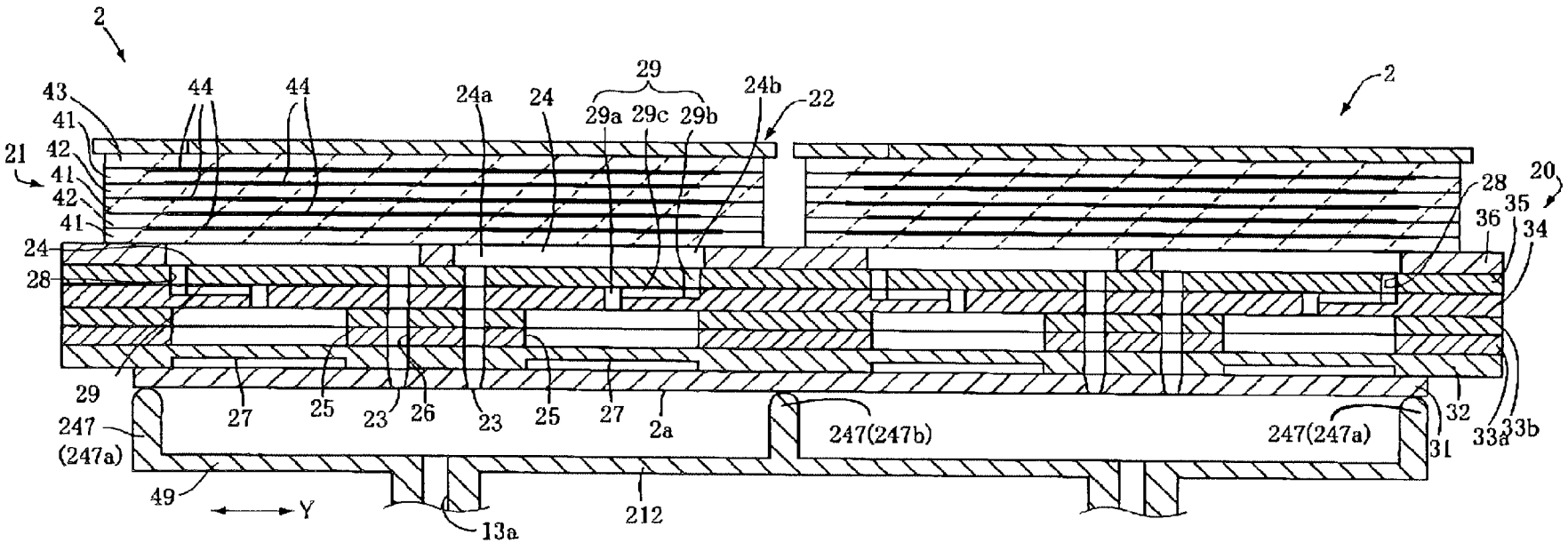
FIG. 11 is a cross-sectional view of an inkjet printhead of an image recording apparatus according to a third embodiment of the invention.

Referring to FIG. 11, there will be described an image recording apparatus according to a third embodiment of the invention. Elements and parts corresponding to those of the first and second embodiments will be denoted by the same reference numerals and description thereof is dispensed with.

The image recording apparatus according to the third embodiment includes two inkjet printheads 2, and each of the inkjet printheads 2 has two nozzle rows, that is, four nozzle rows in total are disposed in the apparatus. The image recording apparatus further includes a first cap 212 that includes a protruding portion 247. The protruding portion 247 includes a circumferential portion 247*a* to be located outside and surround an area including all the common ink chambers 25 and the nozzle rows of the two inkjet printheads 2, and at least one sectioning portion 247*b* sectioning the area into a plurality of sections, such that any portion 247*a*, 247*b* of the protruding portion 247 does not intersect any one of the common ink chambers in plan view.

According to the third embodiment where the cap 212 is relatively large in size so as to be disposed outside and to surround the area including all the common ink chambers and the nozzle rows, manufacture of the cap is made easy even where each inkjet printhead is reduced in size to decrease an area of the inkjet printhead in plan view, since the size of the cap 212 is allowed to be relatively large.

Figure 12:
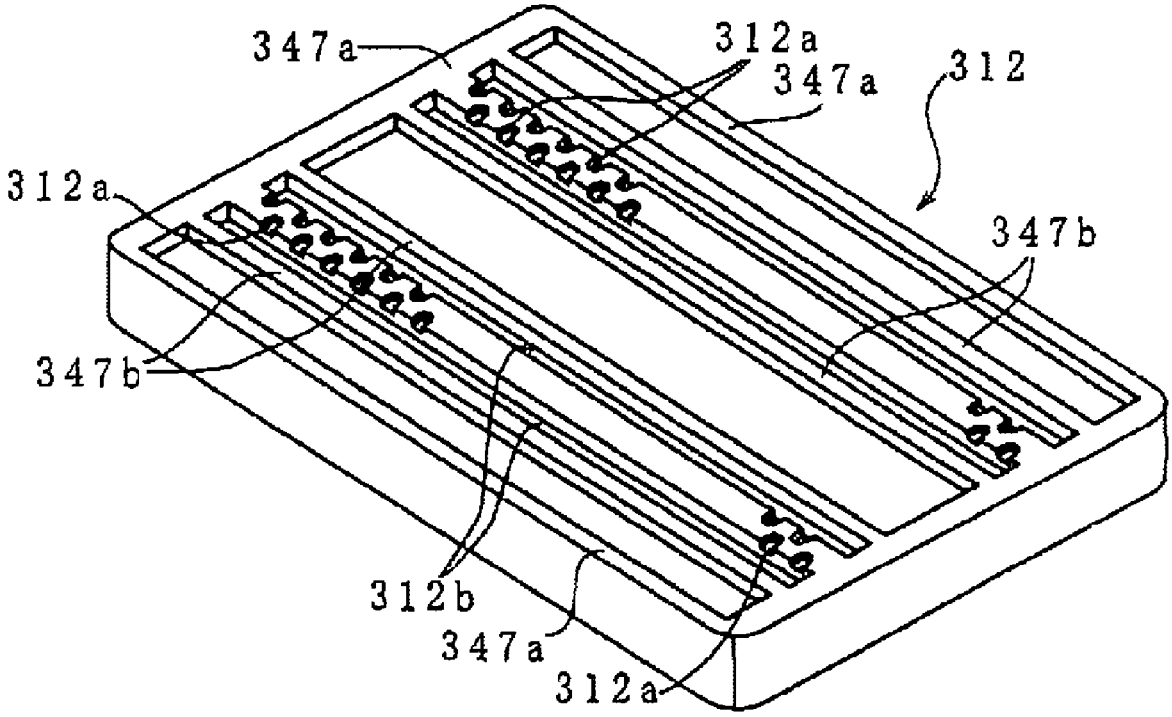
FIG. 12 is a perspective view of a first cap to cover a nozzle surface of an inkjet printhead of an image recording apparatus according to a fourth embodiment of the invention.
Figure 13:
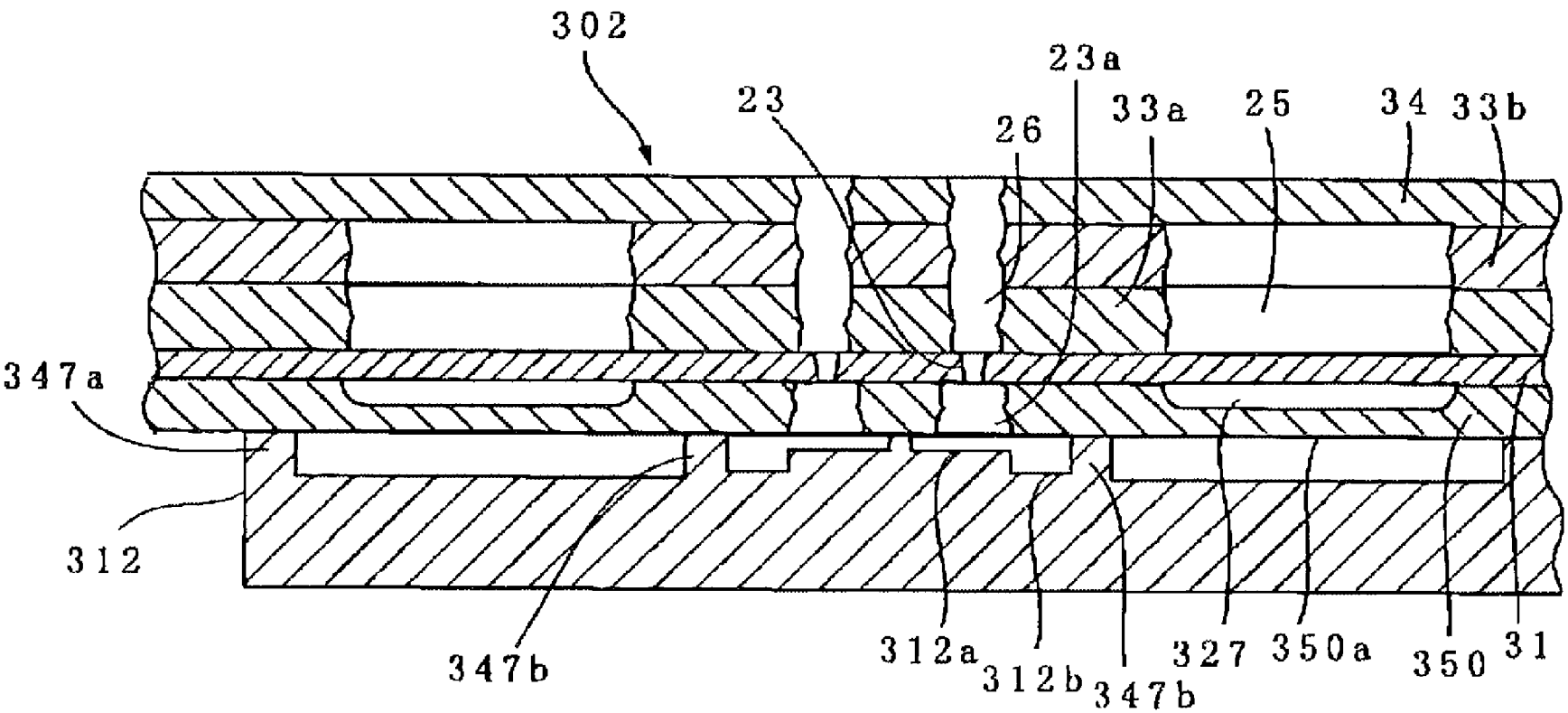
FIG. 13 is a cross-sectional view of a state where the cap covers or in contact with the nozzle surface of the inkjet printhead.

Referring now to FIGS. 12 and 13, there will be described an image recording apparatus according to a fourth embodiment of the invention. Elements or parts corresponding to those of the first through third embodiments will be denoted by the same reference numerals and description thereof is dispensed with.

FIG. 12 shows a first cap 312. In a surface of the first cap 312 to be opposed to inkjet printheads 302, there are formed a plurality of dents 312*a* and a plurality of main channels 312*b*. Each dent 312*a* is communicated with a corresponding one of the main channels 312*b*, and is opposed to a corresponding one of nozzles 23, or one of through-holes 23*a* formed in a cover plate 350 of each inkjet printhead 302 at places corresponding to the nozzles 23, when the first cap 312 is brought into close contact with a front surface 350*a* of the cover plate 350 of each inkjet printhead 302. The front surface 350*a* constitutes a lower surface of the inkjet printhead 302. The cap 312 has a protruding portion 347 that includes a circumferential portion 347*a* and four sectioning portions 347*b*. When the cap 312 is in contact with the front surface 350*a*, the circumferential and sectioning portions 347*a*, 347*b* contact the front surface 350*a*, such that each pair of the sectioning portions 347*b* are disposed on the opposite sides of a pair of rows of dents 312*a* that correspond to a pair of nozzle rows, so that the protruding portion 347 surrounds an area including only the nozzle rows. This arrangement is possible where common ink chambers 25 are disposed on the opposite sides of nozzles rows with a relatively large spacing from the nozzle rows in plan view. It is noted that in FIG. 13 reference numeral 327 denotes a damper chamber.

The structure of the cavity unit is not limited to the details of that in the above-described embodiments, but may be modified as needed. For instance, as shown in FIG. 11, the connecting passages 29 may be formed in a cavity plate 36 through which the pressure chambers 24 are formed, such that each connecting passage 29 is continuous from the pressure chamber 24.

In the inkjet printhead of the invention, a piezoelectric actuator is employed as an actuator, but other types of actuators may be employed.

What is claimed is:

1. An image recording apparatus comprising:

an inkjet printhead having:

a plurality of pressure chambers;

a common ink chamber that is commonly connected to the pressure chambers to supply ink therefrom to the pressure chambers;

a nozzle surface including:

a nozzle area in which a row of nozzles respectively connected to the pressure chambers are open, the ink supplied to the pressure chambers being then supplied to the corresponding nozzles to be ejected therefrom; and an overlapping area that overlaps with the common ink chamber in a direction perpendicular to the nozzle surface;

a cap which has a close-contact portion, and is configured to shift into contact with, and away from, the nozzle surface, and when in contact with the nozzle surface, the cap air-tightly closing the nozzle surface with the close-contact portion encircling the nozzle area and not contacting the overlapping area;

wherein the inkjet printhead is constituted by a laminate of a plurality of plates including a first plate through which the nozzles are formed, and a second plate through which an opening constituting the common ink chamber is formed, the first plate being disposed to be opposed to the cap, and the second plate being disposed directly on a side of the first plate remote from the cap; and wherein the common ink chamber extends along the nozzle row and at a position away from the nozzle row in a direction perpendicular to an extending direction of the nozzle row in a surface of the second plate.

2. The image recording apparatus according to claim 1, wherein the close-contact portion is configured to surround the nozzle area and the overlapping area when the cap is in contact with the nozzle surface.

3. The image recording apparatus according to claim 2, wherein a plurality of the nozzle rows are formed in parallel with each other while a plurality of the common ink chambers are formed on opposite sides of the nozzle rows and at positions separate from the nozzle rows in a direction perpendicular to an extending direction of each of the nozzle rows, and the close-contact portion is configured to surround the nozzle area in which the nozzle rows are formed, and the overlapping area overlapping the common ink chambers.

4. The image recording apparatus according to claim 1, wherein the close-contact portion is configured to surround the nozzle area but not the overlapping area.

5. The image recording apparatus according to claim 4, wherein a plurality of the nozzle rows are formed in parallel with each other while a plurality of the common ink chambers are formed on opposite sides of the nozzle rows and at positions separate from the nozzle rows in a direction perpendicular to an extending direction of each of the nozzle rows, and the close-contact portion is configured to surround the nozzle area in which the nozzle rows are formed, but not the overlapping area overlapping the common ink chambers.

6. The image recording apparatus according to claim 1, wherein the nozzles are formed in a plurality of groups located separately from each other, and the close-contact portion is configured to surround each of the groups of the nozzles individually.

7. The image recording apparatus according to claim 6, wherein the close-contact portion includes a circumferential portion to surround the groups of the nozzles, and a sectioning portion which sections an area surrounded by the circumferential portion into a plurality of areas.

8. The image recording apparatus according to claim 1, wherein the close-contact portion is constituted by an end portion of a protruding portion protruding toward the nozzle surface from a surface of the cap which surface is opposed to the nozzle surface.

9. The image recording apparatus according to claim 1, wherein the cap air-tightly closes the nozzle surface with an entirety of the close-contact portion encircling the nozzle area and not contacting the overlapping area when the cap is shifted into contact with the nozzle surface.

10. The image recording apparatus according to claim 1, wherein the overlapping area is an entirety of a part of the nozzle surface overlapping with the common ink chamber in a direction perpendicular to the nozzle surface.

* * * * *